United States Patent [19]

Stolpin

[11] 4,012,872

[45] Mar. 22, 1977

[54] GEODESIC DOME-LIKE PANELS

[76] Inventor: Roger Mitchell Stolpin, 1629 Ohio Ave., Flint, Mich. 48506

[22] Filed: May 11, 1976

[21] Appl. No.: 685,239

[52] U.S. Cl. ..... 52/81; 52/127; 52/601

[51] Int. Cl.[2] ..... E04B 1/32

[58] Field of Search ..... 52/80–82, 52/70, 71, 601, 127

[56] References Cited

UNITED STATES PATENTS

| | | | |
|---|---|---|---|
| 1,218,846 | 3/1917 | Farnquist | 52/70 |
| 2,057,942 | 10/1936 | Fay | 52/70 |
| 2,776,521 | 1/1957 | Zimmerman | 52/DIG. 10 |
| 3,093,259 | 6/1963 | Morrison | 52/DIG. 10 |
| 3,271,895 | 9/1966 | Sorensen | 52/DIG. 10 |
| 3,296,755 | 1/1967 | Chisholm | 52/81 |
| 3,332,178 | 7/1967 | Foster | 52/70 |
| 3,531,851 | 10/1970 | Douglas | 52/81 |
| 3,921,349 | 11/1975 | Kolozsvary | 52/81 |
| 3,959,937 | 6/1976 | Spunt | 52/81 |

FOREIGN PATENTS OR APPLICATIONS

| | | | |
|---|---|---|---|
| 1,328,631 | 8/1973 | United Kingdom | 52/81 |

OTHER PUBLICATIONS

R.C.A. TNN 431 Jan. 1961.

*Primary Examiner*—Price C. Faw, Jr.
*Assistant Examiner*—Henry Raduazo
*Attorney, Agent, or Firm*—Reising, Ethington, Barnard, Perry and Brooks

[57] ABSTRACT

A geodesic dome-like structure of the disclosure is constructed from a plurality of generally equilateral triangular panels whose sides are each defined by a plurality of elongated rods extending in spaced relationship to each other. Opposite ends of the rods associated with each panel side are secured to the ends of the rods associated with the other two sides. A plurality of generally planar hinge plates are fixed to the rods in a longitudinally spaced relationship and have their planes oriented perpendicular to the elongated direction of the rods. Pintles pivotally interconnect the hinge plates associated with adjacent panel sides about axes intermediate the rods so that the panels pivot relative to each other about axes located outwardly from their sides. The pintles take the form of elongated pintle rods or headed pins. Preferably, two elongated rods are associated with each panel side and in one embodiment the hinge plates have triangular shapes while in another embodiment the hinge plates have washer shapes. The two elongated rods associated with each panel side are spaced radially with respect to the dome structure and the pintles are located radially intermediate the rods as well as intermediate the panel sides so as to provide a high strength interconnection between the panels. Enclosed openings in the hinge plates may receive the panel side rods in an inserted relationship or slots in the periphery of the hinge plates may receive these rods intermediate their ends during assembly. When metallic hinge plates and rods are utilized, the hinge plates are fixed to the rods by welding after being received within the hinge plate openings or slots and the ends of the rods are then secured to each other by welds as well.

13 Claims, 8 Drawing Figures

GEODESIC DOME-LIKE PANELS

BACKGROUND OF THE INVENTION

1. Field of the Invention

This invention relates generally to geodesic dome-like structures including interconnected triangular panels and, more particularly, to such structures whose panels are pivotally interconnected during assembly.

2. Description of the Prior Art

Geodesic dome structures are polygonal bodies whose sides are so numerous that they appear spherical or partially spherical in shape. Such structure can be generated by starting with a regular icosahedron and a sphere whose surface passes through the apices of the icosahedron. A regular icosahedron is a polyhedron having twenty identical faces in the form of equilateral triangles. These triangular faces are then subdivided in various ways and vertices of these subdivided portions are then projected outwardly in a radial direction with respect to the sphere to its surface at various points. The points are then connected by straight lines to form polygons and a plane through the interconnected straight lines of each polygon then forms the outer face of the geodesic dome. Such a dome structure so generated is generally spherical is shape.

Although there are many ways to subdivide the faces of an icosahedron to generate a geodesic dome, high strength dome structures are provided when the outer faces of the dome are in the form of triangles that are substantially equliateral. Two methods by which geodesic domes can be formed with substantially equilateral triangular faces are referred to as the "triacon" breakdown and the "alternate" breakdown. The number of faces formed on the resultant geodesic dome with either of these methods, as well as with other types of breakdowns, depends on the "frequency" of the breakdown. Generally, the frequency is normally on the order of two, three, or four and defines the number of times the icosahedron faces are subdivided before the vertices are projected outwardly to the surface of the sphere.

In the "triacon" breakdown, the angles of the icosahedron faces at their vertices are bisected and the intersection of the three lines so generated forms a point which is connected with each of the vertices by lines of equal length. Using this point as the center and the length of these three lines, six equilateral triangles are then generated about the point. Consequently, there is an overlapping of the triangles formed from adjacent faces of the icosahedron. At this stage, projecting the vertices of the triangles formed outwardly in a radial direction to the sphere surface would form the points necessary to generate geodesic dome faces for a two frequency dome. The triangles can be further subdivided in the same manner and then projected outwardly to the sphere surface to form faces for other even number frequency domes, however, odd number frequency domes with this breakdown are not possible.

In the "alternate" breakdown, points are located along the sides of the triangular icosahedron faces so as to divide these sides into a number of portions of equal length in accordance with the frequency to be utilized. One point at the midpoint of the triangular sides is utilized to provide two equal length portions for a two frequency dome, while two points are utilized to provide three equal length portions for a three frequency dome, etc. Lines are then drawn through these points parallel to the sides of the icosahedron faces so as to divide the faces into a plurality of triangles, the number of which depends upon the frequency. For an alternate breakdown of two frequency, four triangles will be defined while nine will be defined for a three frequency breakdown and sixteen will be defined for a four frequency breakdown. Since the sides of the triangles formed by this subdividing are located at various distances from the triangular icosahedron face vertices, and likewise in their triacon breakdown, projection of the points defining their vertices out to the sphere that encompasses the icosahedron does not result in the formation of completely equilateral triangles whose sides are all precisely equal to each other. Rather, the points furthest from the vertices are located inward from the sphere surface a greater distance than those closer to the vertices and, consequently, outward projection of the points to the sphere surfaces causes them to intersect with the sphere surface at locations spaced from each other varying distances. The points closer to the icosahedron face vertices will intersect with the sphere at locations slightly closer to each other than the points further from the vertices. Connection of the locations of intersection then generates triangular dome faces that are close to being equilateral but not precisely of this shape. For a two frequency alternate breakdown, the triangular faces of the dome generated are of isosceles shape with their longer and shorter sides having lengths within fifteen percent of each other so as to be close to being equilateral. Likewise, for a three or four frequency dome, each isosceles triangular face of the dome has longer and shorter sides whose lengths are also within approximately fifteen percent of each other.

The now expired patent of Richard Buckminster Fuller, 2,682,235 discloses the original geodesic dome type structure to which this invention relates. Other geodesic dome-like structures are shown by subsequent Fuller U.S. Pat. Nos. listed as follows: 2,914,074; 3,197,927; and 3,206,144.

To construct a geodesic dome from struts that extend along the sides of the dome faces and have opposite ends connected to each other, interconnection of the struts to assemble the dome is somewhat complicated by the fact that compound angles are necessary in order to engage the strut ends with each other for securement. Reference should be made to the U.S. Pat. of Miller No. 3,114,176 for a more complete understanding of this problem. Triangular dome panels utilized to form a dome structure or the like have in the past been pivotally interconnected to eliminate the problem caused by the compound angles necessary to engage strut ends with each other to form a rigid structure. This type of pivotal interconnection is shown by the following U.S. Pat. Nos.: 3,343,324; 3,640,034; and 3,921,349.

Other geodesic domes and related structures are disclosed by the following U.S. Pat. Nos.: 3,077,702; 3,341,989; 3,362,127; 3,871,143; and 3,909,994.

SUMMARY OF THE INVENTION

An object of the present invention is to provide a geodesic dome-like structure including generally equilateral triangular panels that have a unique construction which is relatively easy to manufacture with a minimum of tooling and which readily permits the panels to be pivotally connected to each other.

Another object of the invention is to provide a geodesic dome-like structure including a plurality of triangular panels having a construction which permits the panels to be pivotally connected to each other with a high strength connection that gives the assembled structure the ability to carry large loads while still being relatively light weight in relationship to the load carried.

The geodesic dome-like structure of this invention includes pivotally interconnected generally equilateral triangular panels whose sides each include a plurality of elongated rods extending in a spaced relationship to each other between vertices of the associated panel. Opposite ends of the rods associated with each side of each panel are secured to the rod ends of rods extending along the other sides of the panel. The spaced relationship between the rods is maintained by a plurality of generally planar hinge plates fixed to the rods in a longitudinally spaced relationship therealong with the planes of the hinge plates oriented perpendicular to the elongated direction of the rods. Pintles pivotally interconnect the hinge plates of each triangular panel with the hinge plates of adjacent triangular panels and are located intermediate the spaced rods of the panel sides connected therebetween so that the panels pivot relative to each other about axes located outwardly from their sides.

In one preferred embodiment disclosed, the pintles comprise elongated pintle rods that connect pivotally interconnected sets of the hinge plates spaced longitudinally along the panel sides, and in another embodiment the pintles comprise headed pins which pivotally interconnect the hinge plates of each set with each other without connecting the spaced sets of the hinge plates along the length of the panel sides. In both of these preferred embodiments, there are two elongated rods associated with each side of each panel. The rods associated with each panel side are spaced radially with respect to the dome structure formed by the panels and the pintles are located radially intermediate the rods as well as being located intermediate the panel sides to provide a construction that functions much like an I-beam in imparting rigidity to the assembled structure. The hinge plates have triangular shapes in one of the embodiments with overlapping vertices of the plates associated with each side connected by a common pintle and with the other two vertices of each plate connected to the two rods of the associated panel side. In the other embodiment, the hinge plates have washer shapes that overlap and form a generally figure 8 configuration when viewed along the direction in which the rods extend.

The hinge plates may define enclosed openings through which the elongated panel side rods and the pintles are inserted during assembly. Alternately, the hinge plates may include slots that receive the elongated rods between their opposite ends as well as enclosed openings through which the pintles are inserted.

The elongated rods are disclosed as having round cross sections, as do the pintles whether embodied as headed pins or elongated pintle rods. All of the dome components, i.e. the elongated rods, the hinge plates, and the pintles, are disclosed as being of metallic material and the various securements of the components to each other is provided by welds. After assembly and pivotal positioning of the panels in the proper location to form the required dihedral angles therebetween, reinforcing members may be utilized to fix the pivotal positions of the panels with respect to each other. Each pair of pivotally interconnected panel sides includes pairs of hinge plates spaced along one of the panel sides, with the hinge plates of each pair spaced from each other by a distance slightly greater than the thickness of a single hinge plate, and with the other panel side including hinge plates spaced therealong and received between the pairs of hinge plates on the adjacent panel sides to provide sets of hinge plates that are pivotally connected by the pintles.

The objects, features and advantages of the present invention are readily apparent from the following detailed description of the preferred embodiments taken in connection with the accompanying drawings.

DETAILED DESCRIPTION OF THE PREFERRED EMBODIMENTS

Figure 1:
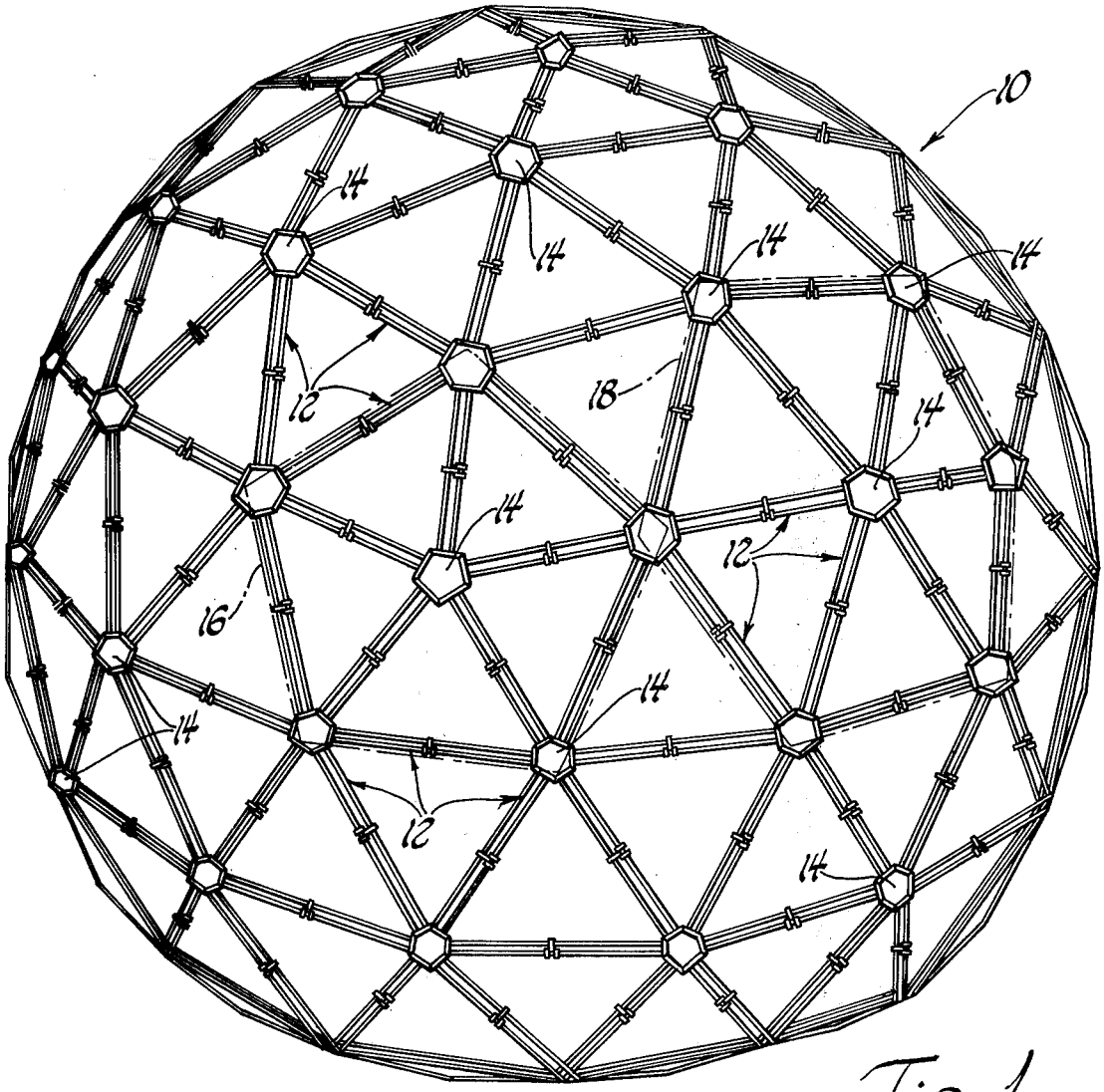
FIG. 1 is a perspective view partially in schematic illustrating a three frequency geodesic dome-like structure generated by an "alternate" breakdown and including triangular panels having a construction in accordance with the present invention.

With reference to the partially schematic view of FIG. 1, a geodesic dome-like structure embodying the present invention is generally indicated by reference numeral 10 and includes a plurality of triangular panels 12 that are interconnected and form the various faces of the structure. Each triangular panel 12 has sides whose lengths are substantially equal, within about fifteen percent or so of each other, so as to form generally equilateral triangular shapes, the actual shape of the triangles being just slightly isosceles. Vertices of each triangular panel are located adjacent associated open spaces 14. As shown, the dome-like structure is constructed by an alternate breakdown of three frequencies and defines pentagons 16 about certain of the open spaces 14 and hexagons 18 about the other open spaces. However, it should be understood that the triangular panel construction to be hereinafter described can also be utilized with other types of breakdowns and various frequencies to generate geodesic dome-like structures.

Figure 2:
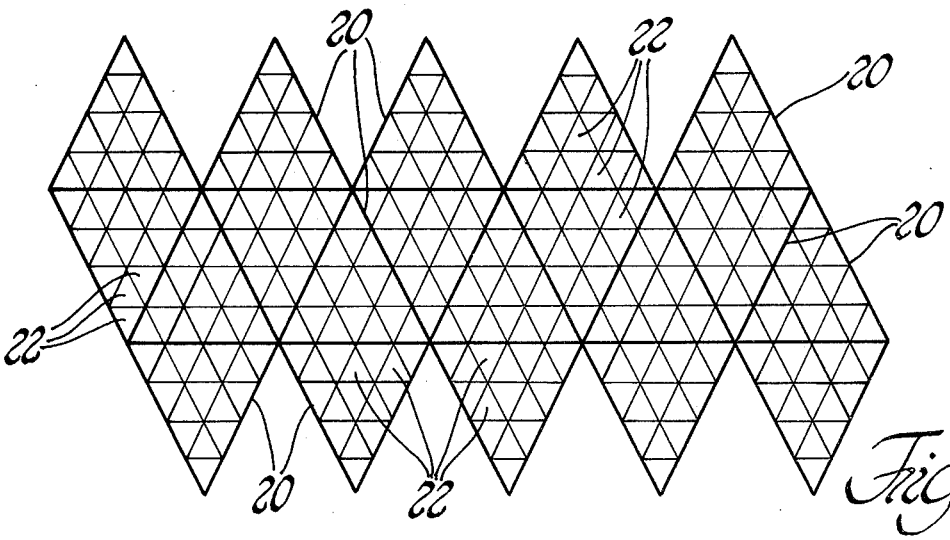
FIG. 2 is a schematic view illustrating an unfolded icosahedron whose faces are subdivided for a four frequency "alternate" breakdown to generate a geodesic dome-like structure.

FIG. 2 is illustrative of the manner in which icosahedron faces 20 are subdivided according to an "alternate" breakdown to generate a geodesic dome of four frequencies. With the icosahedron faces 20 folded to form an icosahedron, the faces of a geodesic dome are generated by first forming a sphere that passes through the apices formed at the junction of the vertices of triangular faces 20. Each face 20 is then subdivided to form triangles 22 by lines that connect equally spaced points on the sides of faces 20, the lines being parallel to the sides and crossing each other at the vertices of triangles 22 so formed. The vertices of each triangle 22 are then projected outwardly in a radial direction with respect to the sphere so as to intersect therewith at various points which are then interconnected by straight lines to form triangular faces of a geodesic dome. The straight lines forming the triangular dome faces would be located intermediate the triangular panels 12 shown in FIG. 1 in a manner that will be hereinafter described in greater detail.

Figure 3:
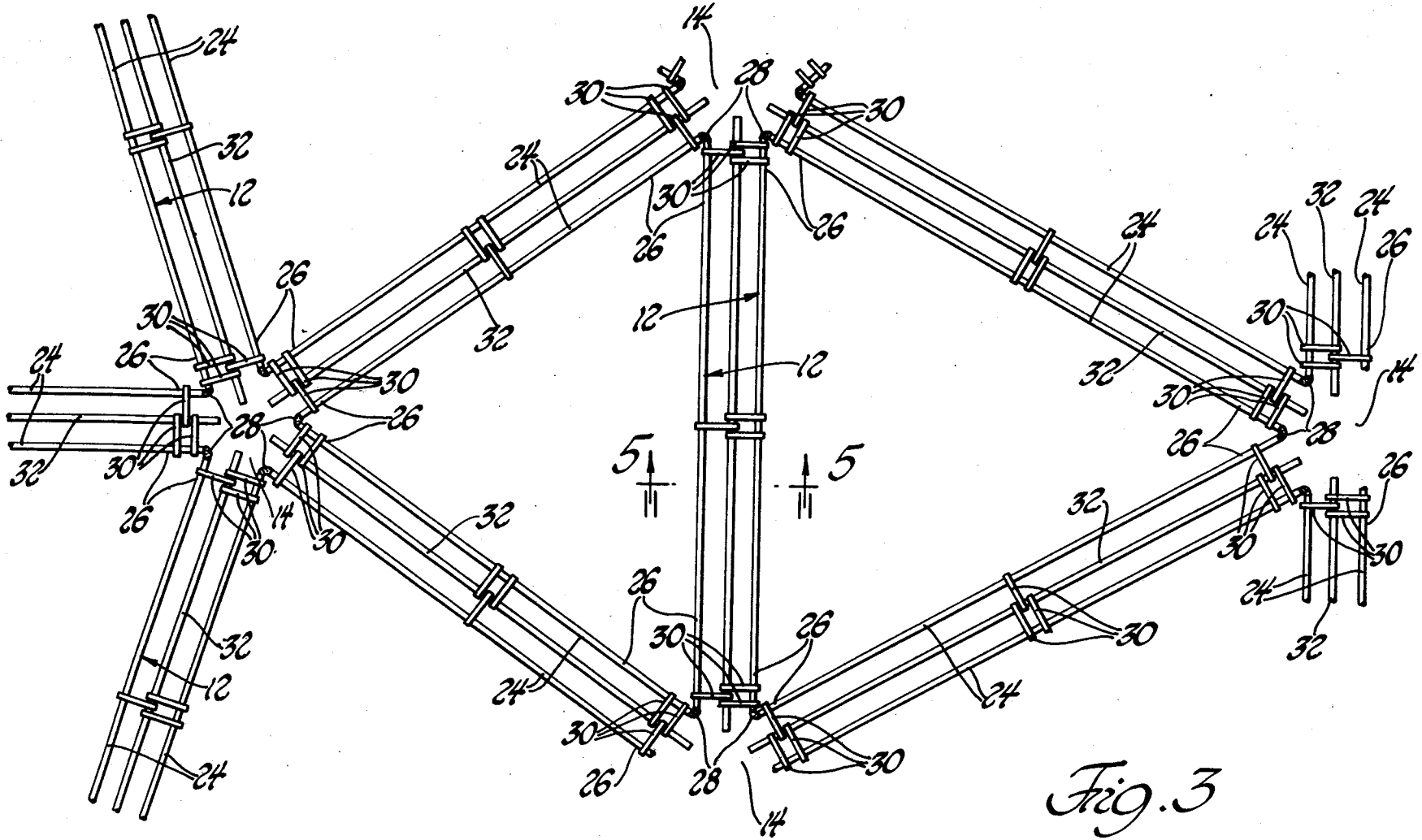
FIG. 3 is an enlarged view showing two pivotally interconnected triangular panels of the dome-like structure shown in FIG. 1.
Figure 4:
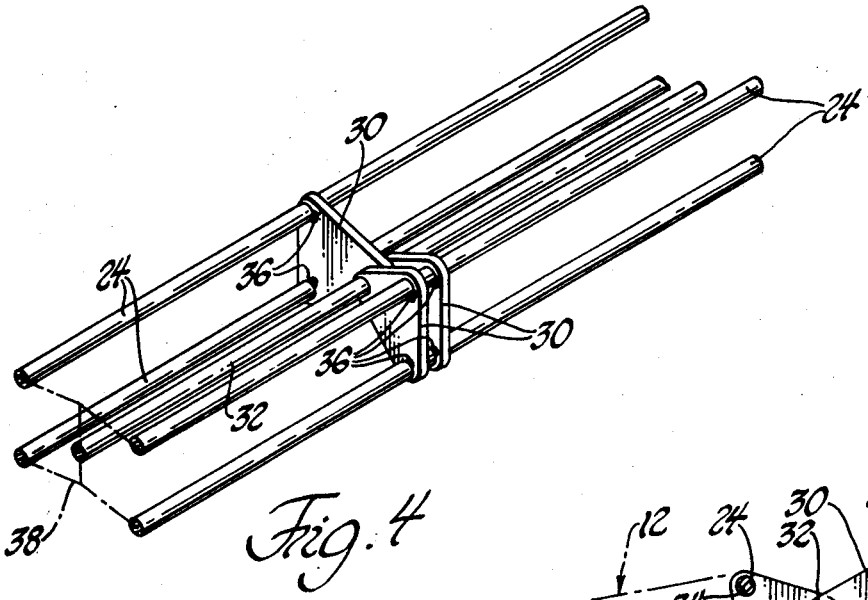
FIG. 4 is a perspective view showing the construction of pivotally interconnected panel sides according to one embodiment as having triangular hinge plates that interconnect spaced elongated rods along each panel side, with the hinge plates being pivotally interconnected by an elongated pintle rod.
Figure 5:
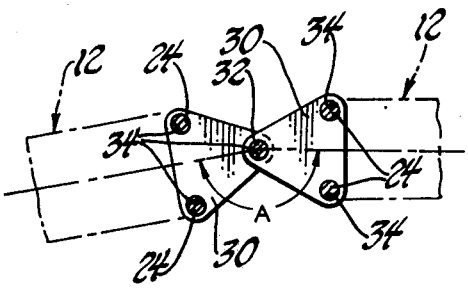
FIG. 5 is a sectional view taken along line 5—5 of FIG. 3 showing the triangular hinge plates also shown in FIG. 4 as well as the elongated rods and the pintle rod.

With combined reference to FIGS. 3 through 5, a plurality of elongated rods 24 are associated with each side of each triangular panel 12. There are two such rods 24 associated with each panel side in the embodiment disclosed by these figures and the rods are made from a suitable metal with round cross sections. The rods associated with each side of each triangular panel have opposite ends 26, FIG. 3, that are suitably secured to associated ends of the rods on the other two sides of the panel by welds 28 or by integral securement if desired. There are thus two triangles associated with each triangular panel 12 and each includes three rods 26 secured to each other by the welds 28. A plurality of generally planar hinge plates 30 are fixed to the rods 24 associated with each panel side and are located in a longitudinally spaced relationship with respect thereto with their planes perpendicular to the direction in which the rods extend. Hinge plates 30 maintain the rods 24 in a spaced relationship with respect to each other such that, with the dome assembled as shown in FIG. 1, the rods are spaced radially relative to the generally sphere-like dome structure formed. Adjacent sides of the triangular panels 12 are pivotally connected by pintles 32 that take the form of elongated pintle rods which interconnect longitudinally spaced sets of the hinge plates 30 along the triangular panel sides. As seen by particular reference to FIG. 5, each pintle 32 is located intermediate the pairs of rods of the two panels 12 pivotally interconnected thereby so that the panels pivot relative to each other about axes located outwardly from their sides. During assembly of the dome structure shown in FIG. 1, the interconnection of the panels causes their planes to be oriented with a dihedral angle A therebetween, FIG. 5. The dihedral angle between any two panels 12 depends upon which two are selected. For a four frequency alternate breakdown geodesic dome, the dihedral angles vary between about one hundred sixty nine and one-half degrees to about one hundred seventy two and two-tenths degrees.

With reference to FIGS. 4 and 5, each of the triangular hinge plates 30 includes an enclosed opening 34 associated with each of its vertices and the rods 24 as well as the associated pintles 32 are inserted through these openings during assembly to form the dome structure. After insertion of the rods 24, welds 36, FIG. 4, are provided to position the hinge plates 30 along the length of the rods. The configuration of the rods 24 and the hinge plates 30 with the pivotal interconnection provided by the pintle 32 is similar in shape to the configuration of an I-beam as shown by the phantom line illustration 38 of FIG. 4. A high strength pivotal connection and high strength dome structure is thus formed by the rod and hinge plate structure shown, and the structure has a high strength to weight ratio. As previously mentioned, the angles between the various triangular panels 12 are fixed with respect to each other by the assembly of the panels into the dome structure shown in FIG. 1. Each pintle 32 then lies along one of the straight lines that defines the junction between two triangular faces of the geodesic dome structure formed in the manner previously described. These lines intersect with each other within the open spaces 14, FIG. 3, where the pintles 32 would intersect with each other if their ends were extended. As previously discussed, the pintles 32 are located intermediate the rods 24 in a radial direction with respect to the resultant dome structure generated and are also located between the adjacent sides of the triangular panels 12 which are pivotally interconnected by the pintles to provide the high strength, light weight dome structure.

The pivotal interconnection provided between the adjacent sides of the triangular panels 12 as shown by the embodiment of FIGS. 3–5 includes longitudinal spaced sets of the hinge plates 30 along each panel side. One panel side includes pairs of the hinge plates that are spaced from each other by a distance just slightly greater than the thickness of a single hinge plate, and the other adjacent panel side includes hinge plates received between the spaced pairs of hinge plates to provide the pivotal interconnection.

It should be noted that the elongated rods 24 may have a cross section other than the round cross section shown and the associated openings 34 in the triangular hinge plate vertices will then have corresponding shapes. However, it is preferable for the pintles 32 to have the round cross section shown so as to permit free pivoting of the panels as the dihedral angles therebetween are formed during assembly.

Figure 6:
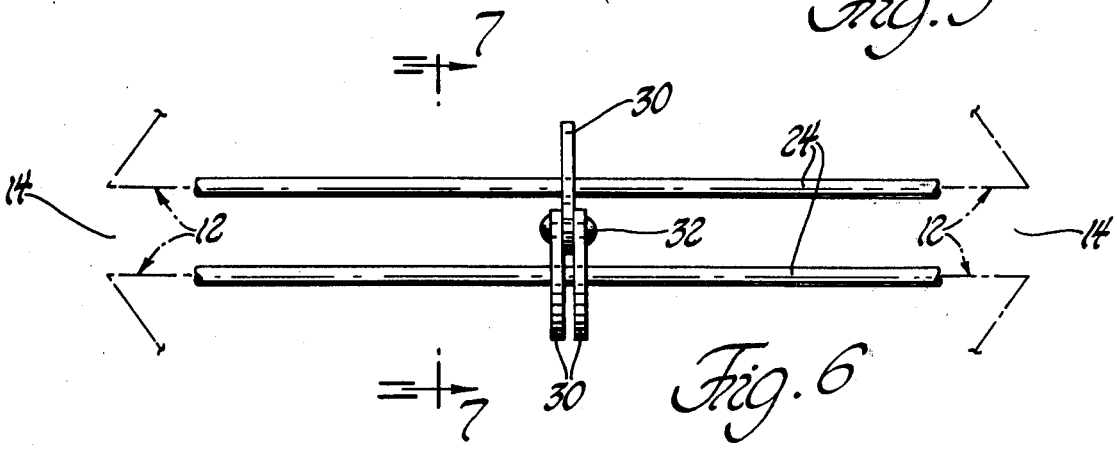
FIG. 6 is a view showing another embodiment of the pivotally interconnected sides of panels utilized to form a dome structure like the one shown in FIG. 1.
Figure 7:
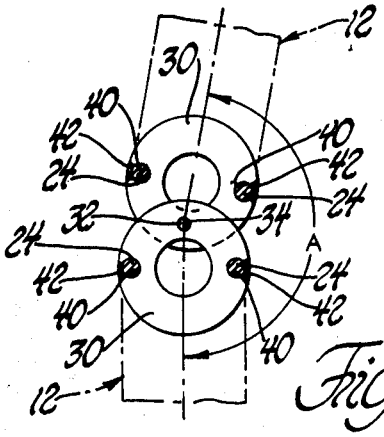
FIG. 7 is a sectional view taken along line 7—7 of FIG. 6 to shown the hinge plates thereof which have washer shapes and form a figure 8 configuration in their pivotally interconnected relationship.
Figure 8:
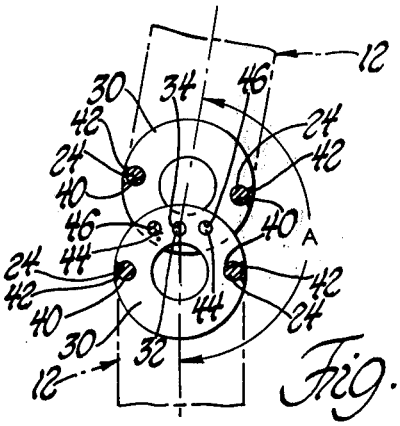
FIG. 8 is a view similar to FIG. 7 of an embodiment wherein the hinge plates are pivotally fixed with respect to each other after assembly by reinforcing members to define the dihedral angles between the associated panel sides.

With reference to FIGS. 6 and 7, an alternate embodiment for pivotally interconnecting the geodesic dome panels 12 is shown with the hinge plates 30 of washer shapes that define a figure 8 configuration when viewed along the elongated direction of the rods 24. Each hinge plate 30 defines a pair of slots 40 that open outwardly to receive the rods 24 intermediate their ends during assembly. Welds 42 are then provided to close the outwardly opening configurations of the slots 40 so as to thereby secure the hinge plates 30 with respect to the rods 24. The pintles 32 of this embodiment take the form of double headed pins, only one shown, that initially have single heads prior to insertion through the aligned pintle openings 34 of the hinge plates and which are subsequently deformed to provide their second needs. Sets of the hinge plates 30 are spaced along the lengths of rods 24 as in the embodiment of FIGS. 3–5, with pairs of the hinge plates on one panel side being spaced to receive hinge plates on the adjacent panel side as in the other embodiment, but with the sets of the hinge plates being unconnected by the pintles. The rods 24, hinge plates 30, and pintles 32 of this embodiment are made of metal in the same manner as the components of the other embodiment, and the rods 24 and pintles 32 also have round cross sections.

The embodiment shown in FIG. 8 is similar to the embodiment shown in FIGS. 6 and 7 but includes reinforcing members 44 that are inserted through aligned openings 46 in the hinge plates subsequent to the insertion of the pintle 32. These reinforcing members may extend between spaced sets of the hinge plates as do the elongated pintle rods 32 shown in FIGS. 3–5 or may take the form of the headed pins like the pintles 32 shown in FIG. 6. The openings 46 through which the reinforcing members 44 are inserted may be formed subsequent to the assembly of the dome provided by the associated triangular panels or, alternately, may be formed prior to the assembly so as to pivotally locate the panels with respect to each other at the proper angle during the construction of the dome. The dihedral angle defined between the planes of the panels depends upon the particular two panels being connected and, as previously mentioned, these angles vary to a slight degree. However, the mathematics involved with respect to the angle between any two triangular panels depends upon mathematic principles that are known to those familiar with geodesic structures and these principles thus need not be stated herein in greater detail.

It should be noted that each of the embodiments shown in FIGS. 6 and 7 and in FIG. 8 form a structure that is of the I-beam shape similar to the phantom line illustration 38 described in connection with the embodiment of FIGS. 3–5. The dome-like structure formed by the triangular panels of each of these embodiments may be covered with a suitable covering so as to form a building. For example, ferro-cement may be utilized to cover the dome structure and enclose it so as to define an enclosed volume. Likewise, the elongated rods and associated hinge plates of the triangular panel sides may be covered by cement so as to have an elongated strut-like configuration of a reinforced concrete construction, and a light weight material may be used to fill the center of each panel and thereby enclose the structure.

In locating the hinge plates 30 of the dome-like structure along the length of the associated triangular panel side, the hinge plates must be positioned so that they can move into the side-by-side relationship shown without abutting each other on their peripheral edges. Thus, a suitable pattern for positioning the hinge plates must be established to provide this required relationship. This can be conveniently done by utilizing a diagram like the one shown in FIG. 2. The length of each side of the triangles 22 after projection thereof outwardly to form a dome face is determined by geodesic mathematic principles known to those skilled in the art. Adjacent sides of triangles 22 are then of the same length and the hinge plates can thus be positioned in the required relationship along their sides. There is a reoccurring pattern of the triangles 22 forming each of the icosahedron faces 20 such that the hinge plate positioning may simply be repeated once it is determined for the outwardly projected triangles of a single icosahedron face. Of course, since certain of the icosahedron faces are upside down with respect to any one face for which the hinge plate positioning is established, the orientations of the triangles 22 having the particular positioning must be taken into account. Likewise, the outwardly projected triangles 22 whose sides define the edges of faces 20 must have their hinge plates properly positioned to permit interconnection of the triangles of these locations.

If a geodesic dome-like structure formed by the teachings of the present invention has a frequency of an even number, i.e. two, four, etc., a hemisphere dome may be provided since there will then be certain panels with aligned sides that form a great circle of the dome. However, if the dome is of an odd number frequency, i.e. one, three, etc., the dome structure must be slightly more or slightly less than a hemisphere in order to have triangular panel sides that form a circle approximately in a plane. In building applications, suitable supports extending upwardly from the ground at appropriate locations to support the triangular panels at their junctures may be utilized with an odd number frequency dome in order to provide a structure that is generally hemispherical. Also, certain of the panels adjacent the ground may be pivoted from their dome face orientation to form entrances and exits from the building. Likewise, the panels may pivot slightly in order to accommodate manufacturing variances that could occur without altering the high strength, light weight pivotal interconnection of the panels. Additionally, the dome structure may be utilized as a framework for supporting mirrors to function as a solar energy collector.

While preferred embodiments have herein been described in detail, those familiar with the art will recognize various alternative designs and embodiments for practicing the present invention as defined by the following claims.

What is claimed is:

1. A geodesic dome-like structure comprising: a plurality of triangular panels having sides of substantially equal length extending between vertices thereof so as to form generally equilateral triangular shapes; each of said triangular panels including a plurality of elongated rods extending along each side thereof in spaced relationship to each other; the rods associated with each side of each panel having opposite ends secured to the rod ends of the rods extending along the other sides of the associated panel; a plurality of generally planar hinge plates fixed to the rods in a longitudinally spaced relationship along each side of each panel with the planes of the plates oriented perpendicular to the elongated direction of the rods; pintles pivotally interconnecting the hinge plates of the triangular panels with the hinge plates of adjacent triangular panels; and said pintles being located intermediate the spaced rods of the panel sides pivotally connected thereby so that the panels pivot relative to each other about axes located outwardly from the panel sides.

2. A structure as in claim 1 wherein the pintles comprise elongated pintle rods that interconnect pivotally connected sets of the hinge plates spaced along the sides of the panels.

3. A structure as in claim 2 wherein there are two elongated rods associated with each triangular panel side, said rods associated with the panel sides being spaced radially from each other with respect to the dome structure, and the elongated pintle rods being located radially intermediate the rods associated with the adjacent panel sides to provide a high strength pivotal interconnection of the panels.

4. A structure as in claim 2 wherein there are two elongated rods associated with each triangular panel side, the hinge plates having triangular shapes, and the hinge plates including vertices defining openings for receiving the elongated panel side rods and the pintle rods.

5. A structure as in claim 1 wherein the hinge plates have washer shapes, the hinge plates of adjacent panel sides overlapping to define generally figure 8 configurations when viewed along the elongated direction of the rods.

6. A structure as in claim 1 wherein the pintles comprise headed pins that pivotally interconnect the hinge plates.

7. A structure as in claim 1 wherein the hinge plates define enclosed openings through which the elongated rods and the pintles are inserted.

8. A structure as in claim 1 wherein the hinge plates define slots that open so the elongated rods can be received therein upon relative movement between each hinge plate and each rod in a direction transverse to the elongated direction of the rod, and the hinge plates defining enclosed openings through which the pintles are inserted.

9. A structure as in claim 1 wherein the elongated rods have round cross sections.

10. A structure as in claim 1 wherein the elongated rods, the hinge plates, and the pintles are all metallic.

11. A structure as in claim 0 including welds securing the hinge plates to the elongated 10 and welds securing the ends of the rods to each other.

12. A structure as in claim 1 wherein each pair of pivotally interconnected panel sides includes pairs of hinge plates spaced along one of the panel sides, with the hinge plates of each pair of hinge plates spaced from each other by a distance slightly greater than the thickness of a single hinge plate, and each other panel side including hinge plates spaced therealong and received between the hinge plates of associated pairs of the hinge plates on the other panel sides to provide sets of the hinge plates along the pivotally connected panel sides.

13. A structure as in claim 1 and also including reinforcing members for pivotally fixing the angle between the panels after interconnection thereof by the pintles.

* * * * *

UNITED STATES PATENT OFFICE

CERTIFICATE OF CORRECTION

Patent No. 4,012,872 Dated March 22, 1977

Inventor(s) Roger Mitchell Stolpin

It is certified that error appears in the above-identified patent and that said Letters Patent are hereby corrected as shown below:

Column 1, line 31 "equliateral" should be --equilateral--.

Column 10, line 5 "claim 0" should be --claim 10--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*